US008540034B2

(12) United States Patent
Poncet et al.

(10) Patent No.: US 8,540,034 B2
(45) Date of Patent: Sep. 24, 2013

(54) PNEUMATIC DRILL DEVICE

(75) Inventors: Julien Poncet, Sury le Comtal (FR); Alain Mucig, Chaponost (FR); Patrice Charlat, Saint Didier sur Rochefort (FR)

(73) Assignee: Sullair Corporation, Michigan City, IN (US)

( * ) Notice: Subject to any disclaimer, the term of this patent is extended or adjusted under 35 U.S.C. 154(b) by 419 days.

(21) Appl. No.: 12/864,922

(22) PCT Filed: Jan. 30, 2009
(Under 37 CFR 1.47)

(86) PCT No.: PCT/FR2009/050136

§ 371 (c)(1),
(2), (4) Date: Oct. 6, 2010

(87) PCT Pub. No.: WO2009/095623

PCT Pub. Date: Aug. 6, 2009

(65) Prior Publication Data

US 2011/0155406 A1 Jun. 30, 2011

(30) Foreign Application Priority Data

Jan. 31, 2008 (FR) ..... 08 00528

(51) Int. Cl.
*B25D 9/04* (2006.01)

(52) U.S. Cl.
USPC ..... 173/128; 173/114; 173/168; 173/169; 173/170; 173/206

(58) Field of Classification Search
USPC ..... 173/168, 169, 170, 162.2, 127, 128, 173/206, 109, 201, 114
See application file for complete search history.

(56) References Cited

U.S. PATENT DOCUMENTS

| | | | | |
|---|---|---|---|---|
| 3,332,504 | A * | 7/1967 | Lowery | 173/162.2 |
| 3,715,705 | A * | 2/1973 | Kuo | 439/422 |
| 3,727,700 | A * | 4/1973 | Amtsberg | 173/18 |
| 4,071,094 | A * | 1/1978 | Kilin et al. | 173/211 |
| 4,189,917 | A * | 2/1980 | Gunning | 60/370 |
| 4,287,810 | A * | 9/1981 | Thoma | 91/299 |
| 4,303,133 | A * | 12/1981 | Godolphin | 173/207 |
| 4,327,807 | A * | 5/1982 | Emonet | 173/207 |
| 4,461,204 | A * | 7/1984 | Emonet | 91/55 |

(Continued)

FOREIGN PATENT DOCUMENTS

| | | |
|---|---|---|
| EP | 009229 A | 4/1980 |
| FR | 689169 A | 9/1930 |

(Continued)

OTHER PUBLICATIONS

French Search Report and Written Opinion mailed on Oct. 29, 2008 for FR0800528.
Published International Search Report mailed on Aug. 17, 2009 for PCT/FR2009/050136.

(Continued)

*Primary Examiner* — Scott A. Smith
(74) *Attorney, Agent, or Firm* — Carlson, Gaskey & Olds, P.C.

(57) ABSTRACT

Pneumatic drill device comprising an outer casing, an assembly of a cylinder and a movable piston actuating a pick element, a device for supplying the cylinder with compressed air, an air exhaust device and an operational control device, wherein the outer casing is formed from two complementary sections adapted to fit into one another in order to enclose, in addition to the cylinder and piston assembly, the said devices for supplying the cylinder, for air exhaust and for operational control.

16 Claims, 3 Drawing Sheets

(56) References Cited

U.S. PATENT DOCUMENTS

| | | | | | |
|---|---|---|---|---|---|
| 4,624,339 | A | * | 11/1986 | Marcel et al. | 181/230 |
| 5,419,404 | A | * | 5/1995 | Niemi et al. | 173/171 |
| 5,524,715 | A | * | 6/1996 | Kimberlin et al. | 173/170 |
| 6,755,260 | B1 | * | 6/2004 | Allan | 173/162.2 |

FOREIGN PATENT DOCUMENTS

| | | | |
|---|---|---|---|
| FR | 2554752 | A | 5/1985 |
| FR | 2581337 | A | 11/1986 |
| FR | 2927010 | | 1/2008 |
| WO | WO0187546 | | 11/2001 |

* cited by examiner

PNEUMATIC DRILL DEVICE

This application is a U.S. National Phase application of PCT Application No. PCT/FR2009/050136 filed Jan. 30, 2009 which claims priority to FR0800528, filed on Jan. 31, 2008.

BACKGROUND

Pneumatic drills with metal bodies are known, which are generally heavy and comprise an operating handle attached to the body.

Owing to their size and weight, these drills do not lend themselves to finish drilling or drilling where there is limited access. Moreover, the air exhaust is evacuated radially onto the cylinder, and this may interfere with the gripping of the cylinder of the apparatus by the user.

SUMMARY

The invention proposes a pneumatic drill device comprising an outer casing, an assembly of a cylinder and movable piston operating a pick element, a device for supplying the cylinder with compressed air, an air exhaust device and an operational control device, characterised in that the outer casing is formed from two complementary sections adapted to fit into one another in order to enclose, in addition to the cylinder and piston assembly, the cylinder supply device, the air exhaust device and the operational control device, and in that at least one channel of the supply device and/or of the exhaust device is formed in at least one of the casing sections, this channel being formed laterally within the thickness of the casing section, parallel to the cylinder.

The enclosed supply, exhaust and control devices are advantageously rigidly trapped between the said casing sections, which are clamped against one another in sealed manner.

The casing sections are adapted in shape so as to house the enclosed devices within their linked portion, the devices thus being "sandwiched" between the two assembled casing sections.

They advantageously comprise at least one layer of material adapted to insulate vibrations and operating noise from the cylinder and piston assembly.

They are advantageously formed by moulding or injection of synthetic materials, for example plastics, and preferably adapted to the use of a small lightweight drill device, preferably using compressed air at low pressure, for example 0.5 to 2.5 bar, for finish drilling or drilling with limited access.

At least one channel of the supply device and/or of the exhaust device may be formed in at least one of the casing sections, thus avoiding the need for external tubing.

The casing sections are advantageously two plastic half-shells which are substantially symmetrical with one another in relation to a longitudinal median plane of the drill device and are adapted to be clamped against one another in sealed manner, for example by a set of screws arranged around their periphery. The two casing sections can thus easily be replaced in the event of wear or breakage.

Their sealed assembly is advantageously provided by means of a peripheral bead around one of the parts, which is squeezed when clamped in a corresponding groove in the other part, optionally onto a flexible joint.

The casing sections are advantageously formed with at least one operating handle for the pneumatic drill device which incorporates the operational control device (control trigger).

The said handle may be offset from the axis of the cylinder and be in the shape of a D one branch of which, the front branch, which is distinct from the rear main branch, protects the operator's hand.

The said front branch of the handle may house at least part of the air exhaust device (for example a baffle), which vents out of the cylinder, for example at the outer end of the handle, without interfering with the operators hand.

The main branch for operating the handle may also incorporate the connection for the supply tubing at its outer end and a supply valve connected to the control member (control trigger).

The front end part of the casing sections, opposite the handle, may also house at least one other air exhaust portion (air exhaust baffle) which vents towards the pick element and hence without impeding the handling of the casing.

In addition, an internal shaping is provided in the casing sections for collecting any air leaks from the enclosed devices and directing them towards the air exhaust device (leaks from the connections in particular).

BRIEF DESCRIPTION OF THE DRAWINGS

The invention is illustrated hereinafter by means of an exemplifying embodiment and with reference to the appended drawings, wherein.

DETAILED DESCRIPTION

Figure 1:
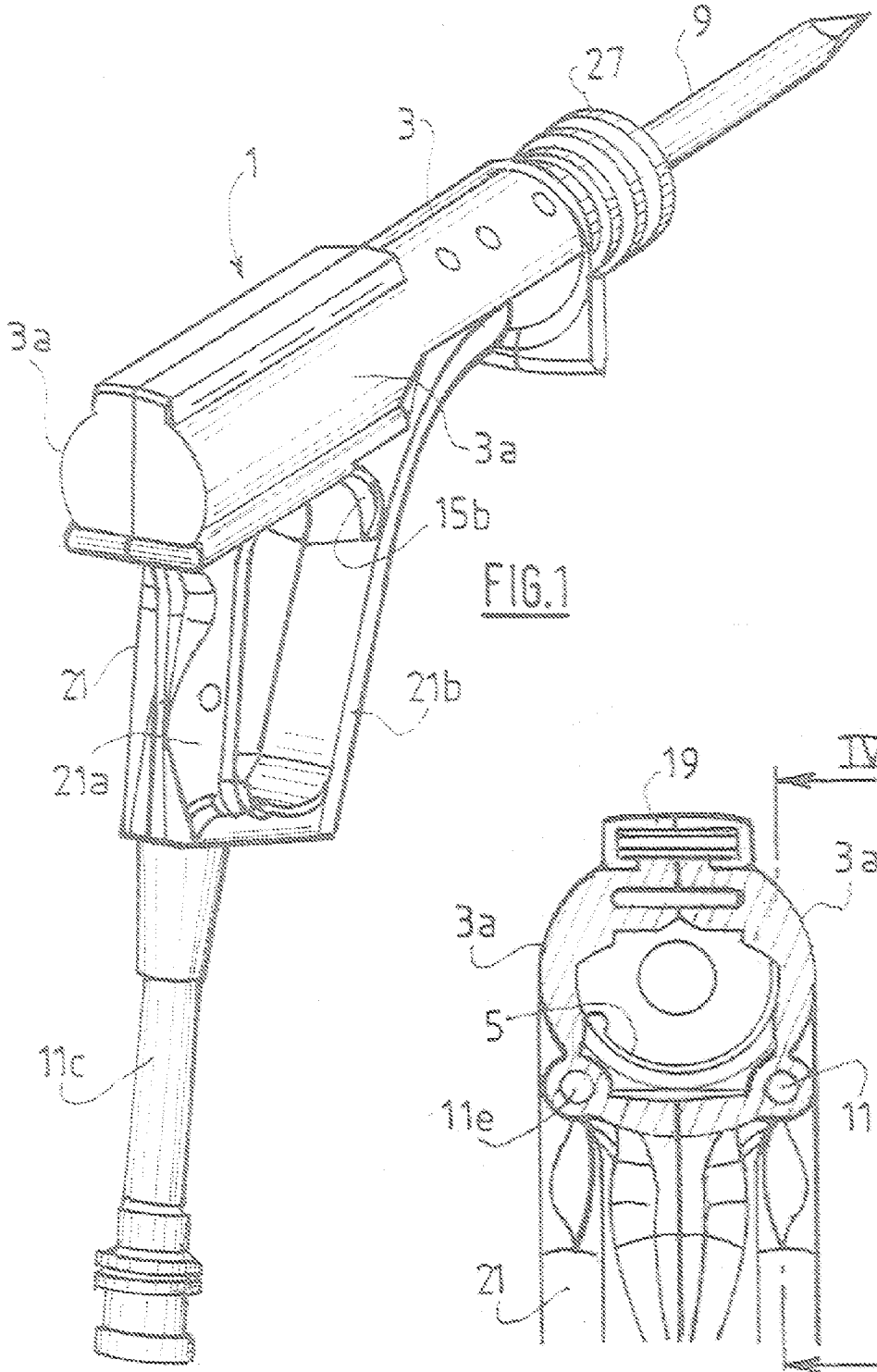
FIG. 1 is a perspective view of a pneumatic drill device according to the invention.
Figure 3:
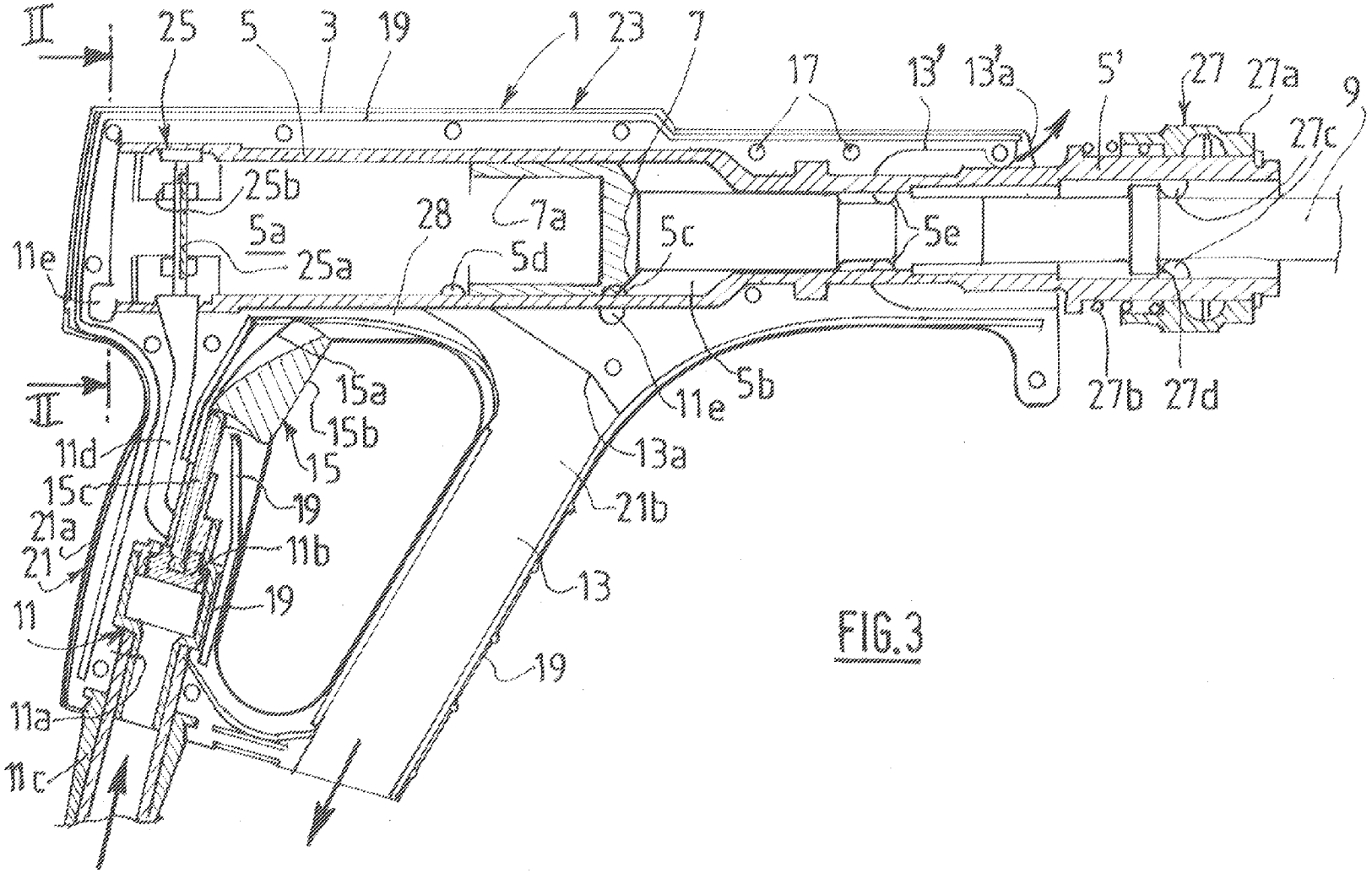
FIG. 3 is an enlarged axial section through the pneumatic drill device.

Referring to the drawings, particularly FIGS. 1 and 3, the pneumatic drill device 1 according to the invention comprises an outer casing 3, an assembly of a cylinder 5 and movable piston 7 operating a pick element 9, a device 11 for supplying the cylinder 5 with compressed air, an air exhaust device 13 and an operational control device 15.

The outer casing 3 comprises two half-shells 3*a* attached to one another along a median longitudinal plane of the device, clamped against one another by means of screws 17 provided around their periphery.

Figures 4, 5:
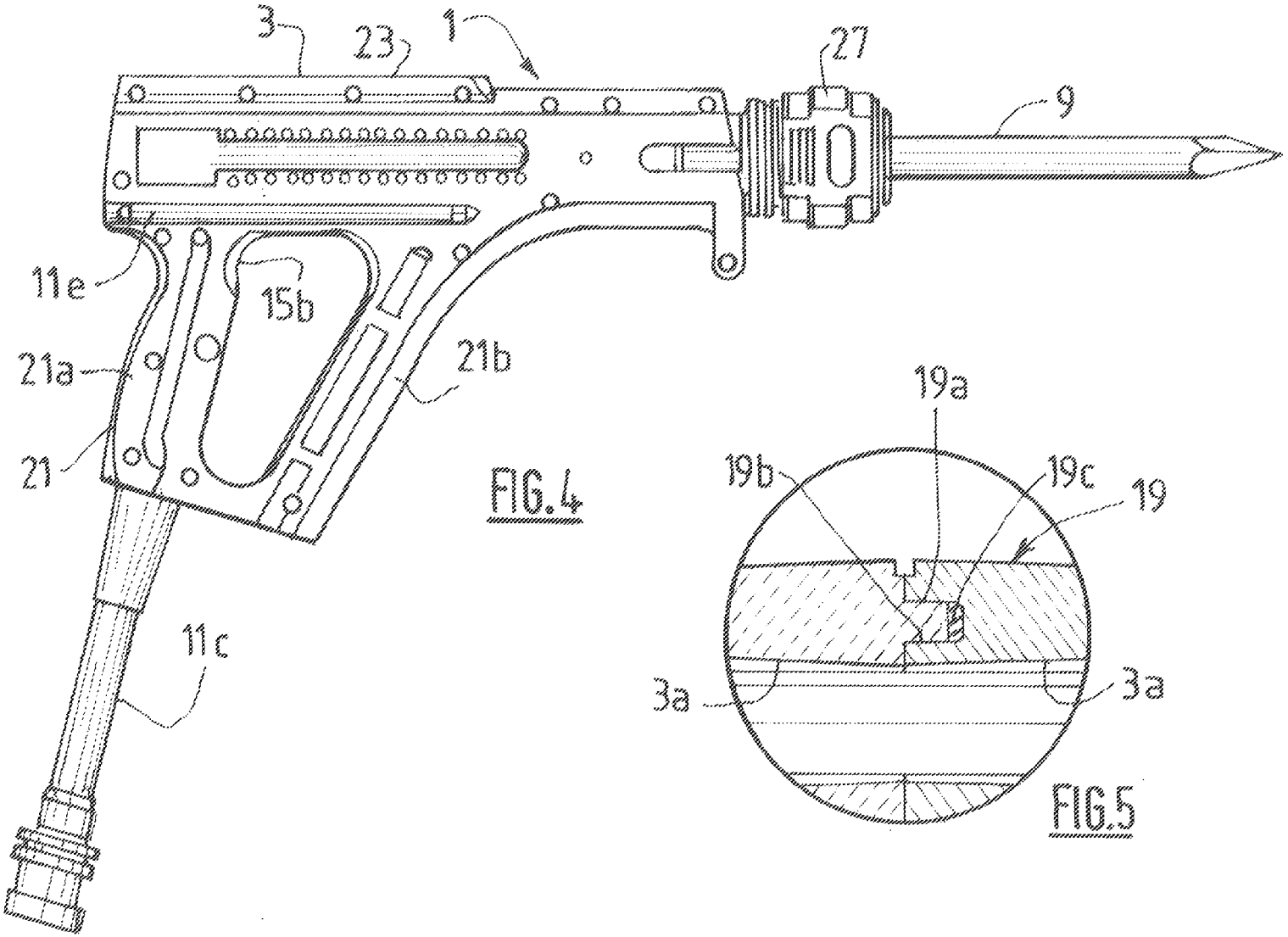
FIG. 4 is a longitudinal section on the line 4-4 in FIG. 2 showing the supply relief channels for the pneumatic drill device.
FIG. 5 is an enlarged partial cross-section showing the attachment of the half-shells of the casing.

These half-shells 3*a*, produced as plastic mouldings, contain the supply device 11, the exhaust device 13 and the control device 15 for the drill device, trapping them rigidly in corresponding housings 11*a*, 13*a*, 15*a*, respectively, formed during the assembling thereof. They are assembled in sealed manner with one another by means of a peripheral joint 19 consisting of a peripheral bead 19*a* on one half-shell which is squeezed when clamped in a complementary groove 19*b* on the other half-shell (FIG. 5) and optionally bears on a flexible joint 19*c* in the base of the groove. The half-shells 3*a* are formed with the operating handle 21 of the pneumatic drill device, which comprises the control member or control trigger 15*b* of the pneumatic drill device mounted on a main rear branch 21*a* of the handle of the device (opposite the pick element 9) protected by a front branch 21*b* connected to the earlier one, thereby forming a D, axially offset from the cylinder 5.

The assembly of the cylinder 5 and piston 7 extends axially substantially along the length of the body 23 of the drill device. In conventional manner the cylinder 5 houses in its rear portion the compressed air distribution portion 25 which is connected to the compressed air supply device 11 mounted in the main branch 21 a of the handle, and it comprises in its front portion the engaging portion of the pick element 9 or advancer 27 mounted on ball bearings. The latter is formed in an enlarged front axial extension 5' of the cylinder, comprising in conventional manner a ring 27*a* movably mounted on its surface, biased forwards by a spring 27*b* and retaining the pick element 9 by means of ball bearings 27*c* trapped in recesses 27*d*, this ring 27*a* being adapted to retract when pushed by the operator counter to the spring 27*b* in order to release the pick element 9.

The piston 7 is hollow, and slidably mounted in the cylinder 5, this piston being adapted to be pushed abruptly towards the pick element 9 under the pressure of the compressed air in the cylinder 5 and on its hollow head 7*a*, to subject it to impact and allow the drill device to act as a pick.

The supply device 11 for the cylinder comprises a supply valve 11*b* located on the extension of the main branch 21*a* of the handle, which is itself connected to a tube 11*c* for supplying compressed air at about 2 bars at its outer end. This valve 11*b* is connected to the trigger 15*b* by a control rod 15*c*. The latter, when closed, without actuation of the trigger, opens a supply channel 11*d* for compressed air to the distribution portion 25 under the operation of the control trigger 15*b*.

Figure 2:
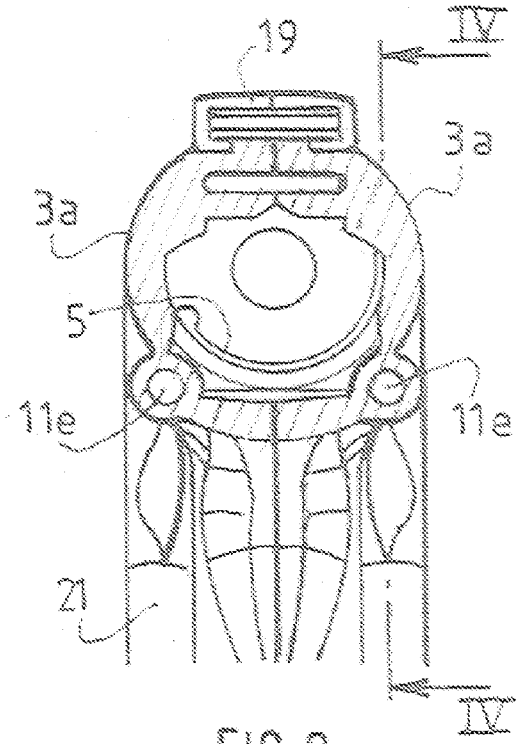
FIG. 2 is a partial cross-section through the pneumatic drill device on the line 2-2 in FIG. 3.

The distribution portion 25 is conventional and comprises a pad 25*a* mounted to be movable back and forth on its seat 25*b* and alternately distributing the compressed air into the upper chamber 5*a* of the cylinder with the aim of pushing the piston 7 towards the pick element 9 or, conversely, supplying the lower part 5*b* of the cylinder via relief control channels 11*e* for the piston (shown in FIGS. 2 and 4) for pushing the latter towards the upper part 5*a* of the cylinder (in the opposite direction to the pick or drill element).

There are two of the relief channels 11*e* mentioned above (there may be from one to several and of variable section, depending on the space available in the casing) each formed laterally within the thickness of the half-shells 3*a*, parallel to the cylinder 5 and at the lower level of the latter. These channels 11*e* are connected to the distribution portion 25, to its rear end and to the cylinder via holes 5*c* opening out at its lower portion 5*b*.

The exhaust device comprises a main part 13 housed in the front branch 21*b* of the handle, which is in the shape of a baffle for channelling the compressed air, linked via holes 5*d* to the cylinder 5 and open at the end of this branch. These baffles extend longitudinally in the space within the branch 21*b* of the handle. They allow compressed air to be evacuated to the outer end of the handle without inconveniencing the operator. Another part of the exhaust device 13' is arranged in the front end portion of the half-shells 3*a*, opposite the handle 21. This portion comprises small baffles connected to the lower part 5*b* of the cylinder via through-holes 5*e* and is connected to the outside of the half-shells 3*a* via holes 13'*a* opening outwards towards the pick element 9.

It should be noted that internal shaping of the half-shells 3*a* may be provided close to the distribution portion 25 and the control trigger 15*b*, in a small space 28 around the cylinder 5, and guide residual leaking air (which is unavoidable) to the main exhaust part 13.

The operation of the pneumatic drill device according to the invention will now be described with reference to FIG. 3.

The compressed air comes from the open supply valve 11*b* (as indicated by the arrow), with the trigger 15*b* actuated, towards the distribution portion 25. Depending on the position of the movable pad 25*a*, the compressed air is conveyed either into the upper chamber 5*a* of the cylinder to push the piston 7 towards the pick element 9 with a striking action, or it is guided in the opposite direction, to the end of the distribution portion 25, to arrive via the two relief channels 11*e* at the lower level 5*b* of the cylinder and allow the piston 7 to move up in order to be struck again, in the conventional mode of operation of a pneumatic drill.

Thus, let us suppose that the piston 7 is in the top position in the cylinder 5 (close to the distribution portion 25), the pad 25*a* being pressed onto its seat 25*b* to the left, and closing off the relief channels 11*e*, the compressed air then travels directly into the upper cylinder chamber 5*a* and abruptly drives back the piston 7 which is moved past the exhaust holes 5*d* of the main exhaust portion 13. At this level, the pressure in the upper chamber 5*a* drops to the level of atmospheric thrust or thereabouts, while the air in the upper chamber is evacuated through the main exhaust portion 13. At the same time, the air cushion compressed by the arrival of the piston 7 between the pick element 9 and the piston 7 is evacuated through the front exhaust portion 13' towards the pick element 9, thus preventing the piston from being slowed down by this air cushion as it travels towards the pick element 9.

The pad 25*a* is thus moved to the opposite position on its seat 25*b*, closing off the intake for compressed air into the upper cylinder chamber 5*a* and opening up access to the relief channels 11*e*. The compressed air then arrives at the lower level 5*b* of the cylinder and pushes the piston 7 back up to the upper level 5*a* of the cylinder for a new striking cycle.

In this embodiment, compressed air at low pressure was used, but it is possible to supply the device with compressed air at high pressure (7 bars, for example) by adapting the cross-sections of the supply, distribution, relief and exhaust passages. The invention thus provides a pneumatic drill device which is simple, can be made in a small size, and is lightweight and economical.

What is claimed is:

1. A pneumatic drill device comprising:

an assembly and an outer casing, said assembly including a cylinder defining a bore and a movable piston, said piston in said bore configured to actuate a pick element, a supply device for supplying the bore with compressed air, and an operational control device, said outer casing being formed from two complementary sections defining an internal cavity enclosing said assembly, said outer casing defining at least one channel in fluid communication with said bore, said at least one channel extending from said internal cavity and formed partially through the thickness of at least one of the casing sections.

2. The pneumatic drill device according to claim 1, wherein said assembly is rigidly fixed between said casing sections which are clamped against one another in sealed manner.

3. The pneumatic drill device according to claim 1, wherein said casing sections are adapted in shape so as to house, in their linked portion, said assembly, which are thus sandwiched between the two assembled casing sections.

4. The pneumatic drill device according to claim 1, wherein said casing sections comprise at least one layer of material adapted to insulate vibrations and operating noise from the assembly.

5. The pneumatic drill device according to claim 1, wherein said casing sections are formed by moulding of synthetic materials.

6. The pneumatic drill device according to claim 1, wherein said casing sections are adapted to the use of a small light-weight drill for finish drilling or drilling with limited access.

7. The pneumatic drill device according to claim 1, wherein said casing sections are two half-shells made of plastics.

8. The pneumatic drill device according to claim 1, wherein one of said casing sections includes a peripheral bead received in a corresponding groove defined by the other said casing section.

9. The pneumatic drill device according to claim 1, wherein said casing sections define at least one operating handle configured to receive the operational control device.

10. The pneumatic drill device according to claim 9, wherein the handle is offset from the axis of the cylinder and includes a front branch and a rear branch configured in the shape of a "D", the front branch configured to protect the operator's hand.

11. The pneumatic drill device according to claim 10, wherein said at least one channel is a first exhaust baffle configured to vent air out of the bore without interfering with the operator's hand.

12. The pneumatic drill device according to claim 11, wherein the casing sections define a residual cavity extending from the internal cavity and in fluid communication with said at least one channel for collecting any air leaks from said assembly.

13. The pneumatic drill device according to claim 10, wherein the rear branch incorporates a supply tubing at an outer end and a supply valve connected to the control device, said supply tubing in fluid communication with said at least one channel.

14. The pneumatic drill device according to claim 1, wherein said at least one channel is configured to vent an amount of air between said piston and said pick element towards the pick element.

15. A pneumatic drill device according to claim 1, wherein said casing sections are symmetrical.

16. A pneumatic drill device according to claim 1, wherein said at least one channel is elongated in a direction from a proximal end and a distal end of said cylinder and is configured to selectively communicate an amount of air from said supply device to said bore when said piston is positioned near said distal end.

* * * * *